US008550929B1

(12) United States Patent
Nebauer-McRae

(10) Patent No.: US 8,550,929 B1
(45) Date of Patent: Oct. 8, 2013

(54) PORTABLE POOL TABLE DEVICE

(76) Inventor: Marie L. Nebauer-McRae, Toormina (AU)

( * ) Notice: Subject to any disclaimer, the term of this patent is extended or adjusted under 35 U.S.C. 154(b) by 90 days.

(21) Appl. No.: 13/281,700

(22) Filed: Oct. 26, 2011

(51) Int. Cl.
*A63D 15/00* (2006.01)
*A63D 15/06* (2006.01)

(52) U.S. Cl.
USPC ..... 473/15; 473/13; 473/4; 473/1

(58) Field of Classification Search
USPC ..... 473/1, 4, 13, 15; 273/309; 108/158, 108/157.1, 59
See application file for complete search history.

(56) References Cited

U.S. PATENT DOCUMENTS

| | | | | | |
|---|---|---|---|---|---|
| 1,349,587 | A | * | 8/1920 | Smith et al. | 273/126 R |
| 1,661,965 | A | * | 3/1928 | Ruse et al. | 473/13 |
| 1,705,890 | A | * | 3/1929 | Bishop | 473/15 |
| 1,725,215 | A | * | 8/1929 | Seal | 473/30 |
| 1,847,344 | A | * | 3/1932 | Kennedy | 108/131 |
| 1,875,198 | A | * | 8/1932 | Nagai | 473/20 |
| 1,881,387 | A | * | 10/1932 | Johnson | 473/3 |
| 1,945,038 | A | * | 1/1934 | Hand | 473/32 |
| 1,979,177 | A | * | 10/1934 | Staff | 473/3 |
| 2,014,788 | A | * | 9/1935 | Strickler et al. | 473/3 |
| 2,092,521 | A | * | 9/1937 | Norris | 473/29 |
| 2,391,395 | A | * | 12/1945 | Debicki | 473/29 |
| D161,407 | S | * | 1/1951 | Anderson et al. | D21/784 |
| D161,408 | S | * | 1/1951 | Anderson et al. | D21/784 |
| 2,540,729 | A | * | 2/1951 | Haskell | 473/13 |
| 2,809,040 | A | * | 10/1957 | Trovato | 473/3 |
| 2,818,256 | A | | 12/1957 | Hopper | |
| 3,069,163 | A | * | 12/1962 | Schaefer | 473/15 |
| 3,138,387 | A | * | 6/1964 | Michel et al. | 473/159 |
| 3,319,958 | A | | 5/1967 | Bender | |
| 3,455,551 | A | * | 7/1969 | Untiedt | 473/22 |
| 3,578,321 | A | * | 5/1971 | Skully et al. | 473/3 |
| 4,579,342 | A | * | 4/1986 | Mortensen | 473/3 |
| 4,838,179 | A | * | 6/1989 | Bing | 108/132 |
| 4,875,680 | A | * | 10/1989 | Gross | 473/14 |
| 4,927,140 | A | * | 5/1990 | Pappas | 473/8 |
| 4,957,288 | A | * | 9/1990 | Kantner et al. | 473/3 |
| 4,989,863 | A | | 2/1991 | Hall | |
| 5,056,780 | A | * | 10/1991 | Tsang | 473/15 |
| 5,810,672 | A | * | 9/1998 | Gorsiski | 473/31 |
| 5,833,546 | A | * | 11/1998 | Wang | 473/3 |
| 6,053,818 | A | * | 4/2000 | McCormick | 473/4 |
| 6,168,533 | B1 | * | 1/2001 | Camara | 473/3 |
| 6,502,819 | B2 | * | 1/2003 | Rieber et al. | 273/126 R |
| 6,641,486 | B2 | * | 11/2003 | Shih | 473/33 |
| 6,846,243 | B2 | * | 1/2005 | Francisco | 473/3 |
| 6,872,147 | B2 | * | 3/2005 | Shih | 473/15 |
| 6,926,613 | B1 | * | 8/2005 | Binning | 473/31 |
| 2008/0156235 | A1 | * | 7/2008 | Keirstead et al. | 108/146 |

FOREIGN PATENT DOCUMENTS

| | | | |
|---|---|---|---|
| FR | 2550458 | A1 * | 2/1985 |
| FR | 2641197 | A1 * | 7/1990 |

* cited by examiner

*Primary Examiner* — Mitra Aryanpour

(57) ABSTRACT

The portable pool table device provides extreme portability by way of disassembly. The table is divided into four separable sections that are selectively assembled as chosen. The affixed sections provide half circle cutouts and half circle cutout shapes for removable pocket attachment. The sections are ideally affixed together by lateral clamps. The felt-atop-rubberized-layer playing surface is removably installed atop the sections upon assembly. The removable side braces and end braces also provide outer brace playing surfaces along with angled bumpers as are used in other pool tables in the art.

16 Claims, 5 Drawing Sheets

PORTABLE POOL TABLE DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Pool tables have been enjoyed by many for countless years. Yet, pool tables are bulky and heavy. The sheer size of a pool table typically requires a very large room, and sometimes extensive disassembly and reassembly by a qualified specialist in order to be installed and properly leveled within a room. The present device provides for users to enjoy pool by virtue of the portable device that is easily disassembled and reassembled by virtually any user, and is further easily leveled, so that almost any chosen area, indoor or out, can be used to play pool.

FIELD OF THE INVENTION

The portable pool table device relates to pool tables and more especially to a pool table that can be easily disassembled and reassembled and thereby transported and used virtually anywhere, indoor or outside.

SUMMARY OF THE INVENTION

The general purpose of the portable pool table device, described subsequently in greater detail, is to provide a portable pool table device which has many novel features that result in an improved portable pool table device which is not anticipated, rendered obvious, suggested, or even implied by prior art, either alone or in combination thereof.

To attain this, the portable pool table device provides extreme portability by way of disassembly. The table is divided into four separable sections that are selectively assembled as chosen. The second section and the third section each have quarter circle cutouts. With the second and third sections affixed together, the quarter circle cutouts provide a half circle cutout shape for removable insertion of a pocket. Each end section has, at the corner perimeters, a half circle cutout for removable pocket insertion. The sections are thereby equipped to removably receive the pockets which are located in the sides and corners as are pockets known to be customarily located in the art. The sections may be affixed together by several means, including bolts, screws, and clamps, with lateral clamps being the preferred means.

The felt-atop-rubberized-layer playing surface is removably installed atop the sections upon assembly. The removable side braces and end braces also provide outer brace playing surfaces along with angled bumpers as are used in other pool tables in the art. The angled bumper rubberized layer may be of different density and thickness as that of the playing surface. Fully eight legs are provided, with two legs per section, to ensure proper table support and leveling, with an adjustable foot on each leg that is threadably attached to receivers of the sections. The legs of the second section and the third section may be disposed more medially than the legs of the first section and the fourth section, thereby providing better table support.

Thus has been broadly outlined the more important features of the improved portable pool table device so that the detailed description thereof that follows may be better understood and in order that the present contribution to the art may be better appreciated.

An object of the portable pool table device is to be easily transported.

Another object of the portable pool table device is to be easily disassembled.

Another object of the portable pool table device is to provide for disassembly of the playing surface.

A further object of the portable pool table device is to be easily assembled.

An added object of the portable pool table device is to be easily leveled.

And, an object of the portable pool table device is to properly support the playing surface of the table device.

These together with additional objects, features and advantages of the improved portable pool table device will be readily apparent to those of ordinary skill in the art upon reading the following detailed description of presently preferred, but nonetheless illustrative, embodiments of the improved portable pool table device when taken in conjunction with the accompanying drawings.

DETAILED DESCRIPTION OF THE DRAWINGS

With reference now to the drawings, and in particular FIGS. 1 through 6 thereof, the principles and concepts of the portable pool table device generally designated by the reference number 10 will be described.

Figure 4:
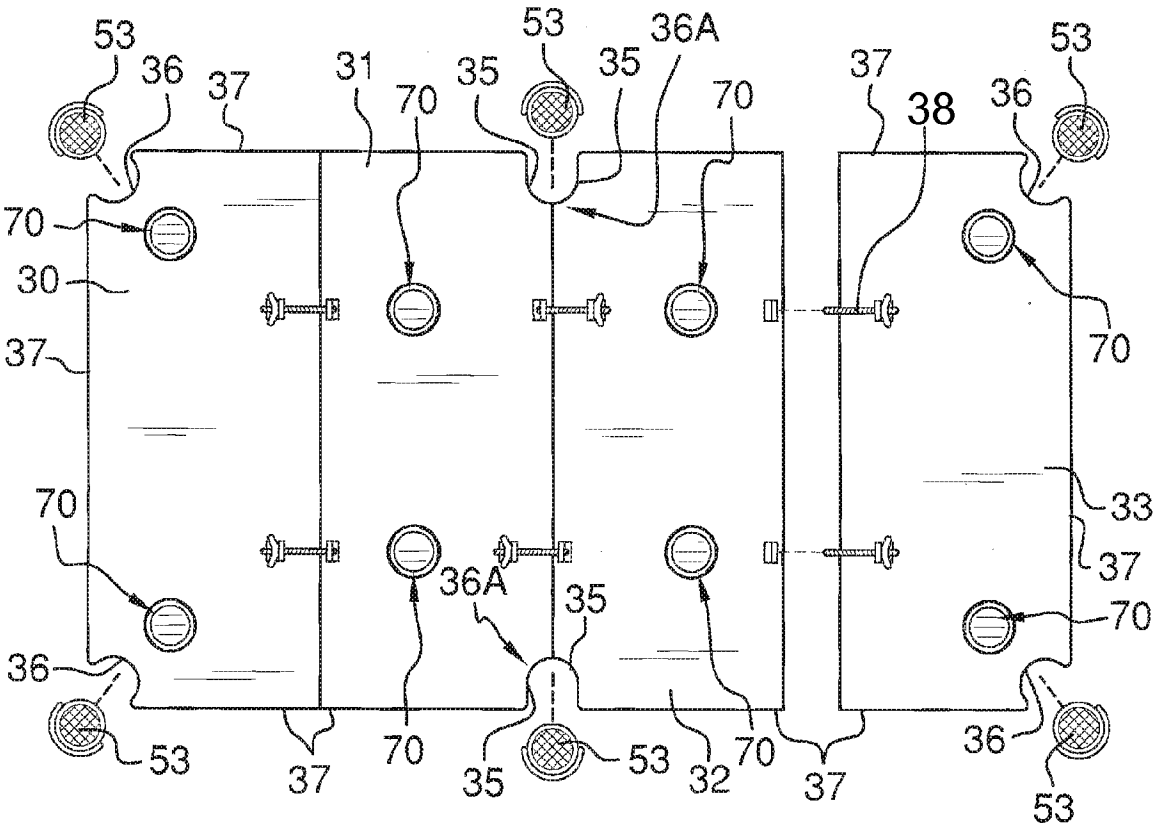
FIG. 4 is a bottom plan view, partially disassembled.
Figure 5:
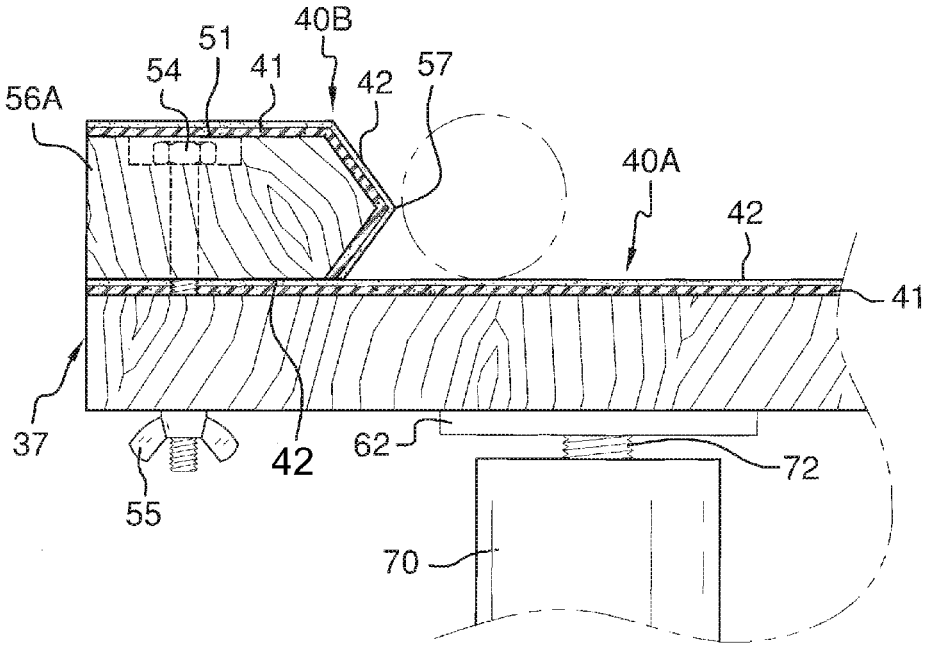
FIG. 5 is a partial cross sectional view of FIG. 3, taken along the line 5-5.

Referring to FIG. 4, the portable pool table device 10 has a first end 20 spaced apart from a second end 21, a first side 22 spaced apart from a second side 23, and a plurality of separable side-by-side sections. The sections comprise a first section 30, a second section 31 removably affixed to the first section 30, a third section 32 removably affixed to the second section 31, and a fourth section 33 removably affixed to the third section 32. Each section has an outer perimeter 37. A plurality of spaced apart lateral clamps 38 removably affixes the sections together.

Figure 6:
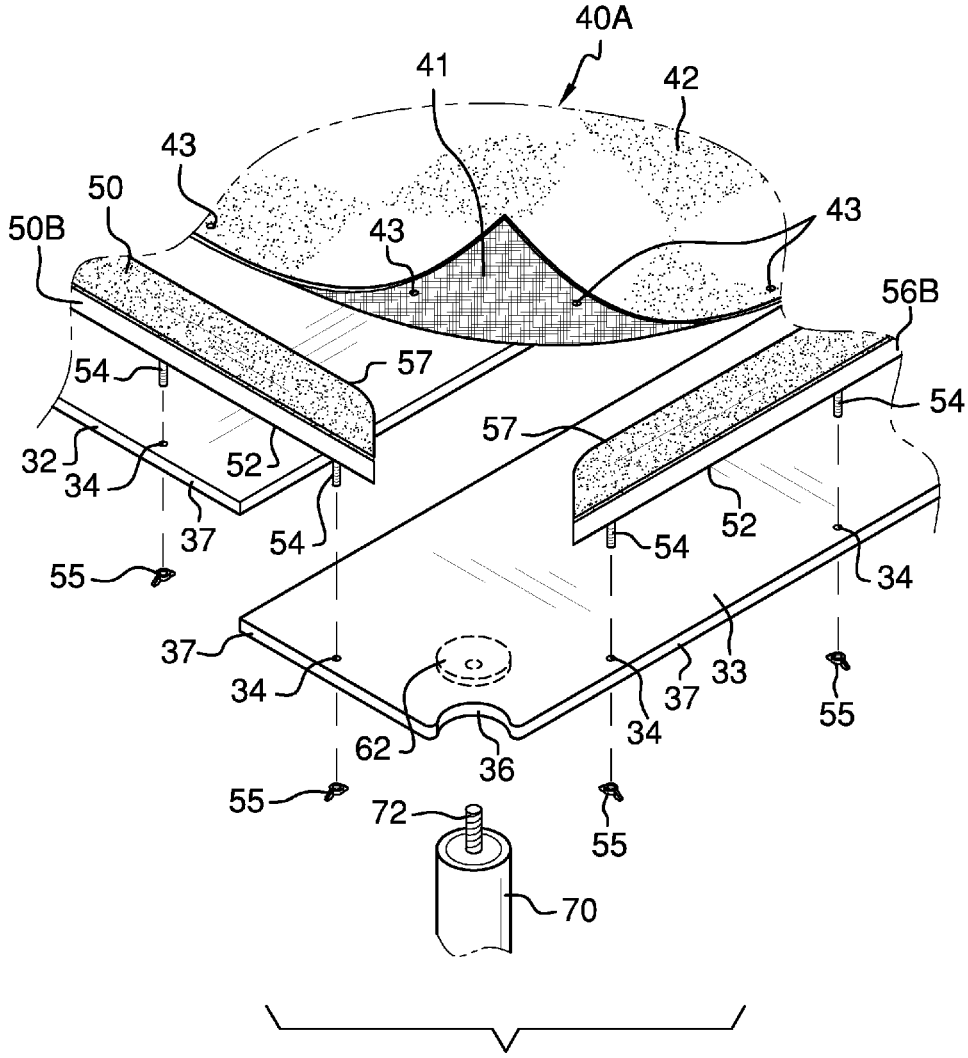
FIG. 6 is a partial top perspective view, disassembled.

Referring to FIG. 6, a plurality of spaced apart holes 34 is disposed in each section proximal to the outer perimeter 37.

Referring again to FIG. 4, a plurality of quarter circle cutouts 35 is provided. A one quarter circle cutout 35 is disposed at the outer perimeter 37 of the second section 31 first side 22 where the second section 31 is affixed to the third section 32. One quarter circle cutout 35 is disposed at the outer perimeter 37 of the second section 31 second side 23 where the second section 31 is affixed to the third section 32. One quarter circle cutout 35 is disposed at the outer perimeter 37 of the third section 32 first side 22 where the third section 32 is affixed to the second section 31. One quarter circle cutout 35 is disposed at the outer perimeter 37 of the third section 32 second side 23 where the third section 32 is affixed to the second section 31. The quarter circle cutouts 35 of the affixed second section 31 and third section 32 are thereby configured to form a pair of half circle cutout shapes 36A. A plurality of half circle cutouts 36 is provided. A one half circle cutout 36 is disposed at the outer perimeter 37 of the first section 30 first end 20 first side 22. One half circle cutout 36 is disposed at the outer perimeter 37 of the first section 30 first end 20 second side 23. One half circle cutout 36 is disposed on at the outer perimeter 37 of the fourth section 33 second end 21 first side 22. One half circle cutout 36 is disposed on at the outer perimeter 37 of the fourth section 33 second end 21 second side 23.

Figure 2:
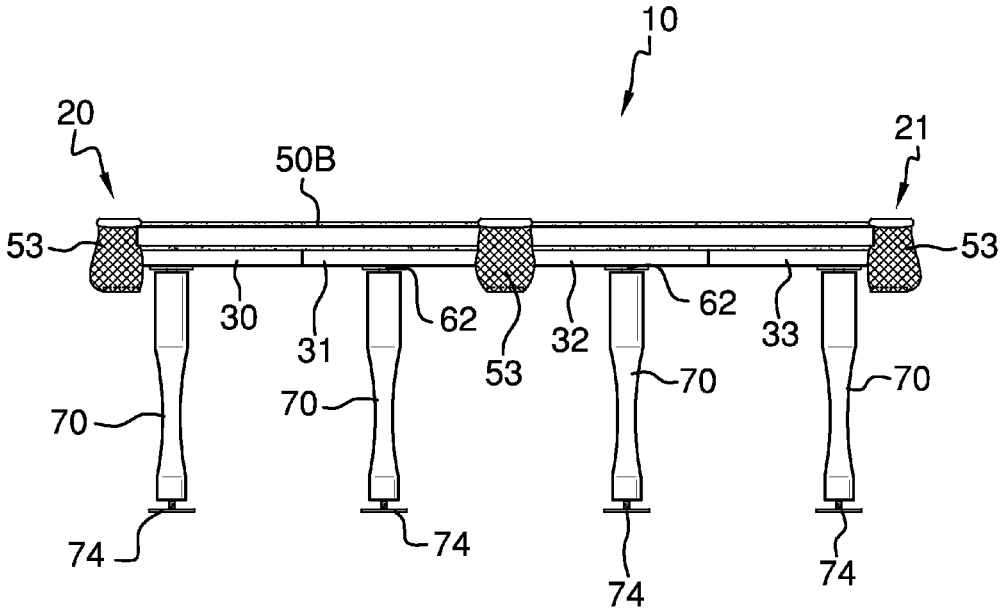
FIG. 2 is a side elevation view.

Continuing to refer to FIG. 4 and also to FIG. 2, a pocket 53 is removably disposed within each half circle cutout shape 36A and within each half circle cutout 26.

Referring to FIG. 6, a playing surface 40A is removably disposed atop the sections. The playing surface 40A comprises a rubberized layer 41 in contact with the sections and a felt cover 42 bonded atop the rubberized layer 41. A plurality of orifices 43 is disposed within the playing surface 40A. The orifices 43 are aligned with the holes 34 of the sections.

Figure 1:
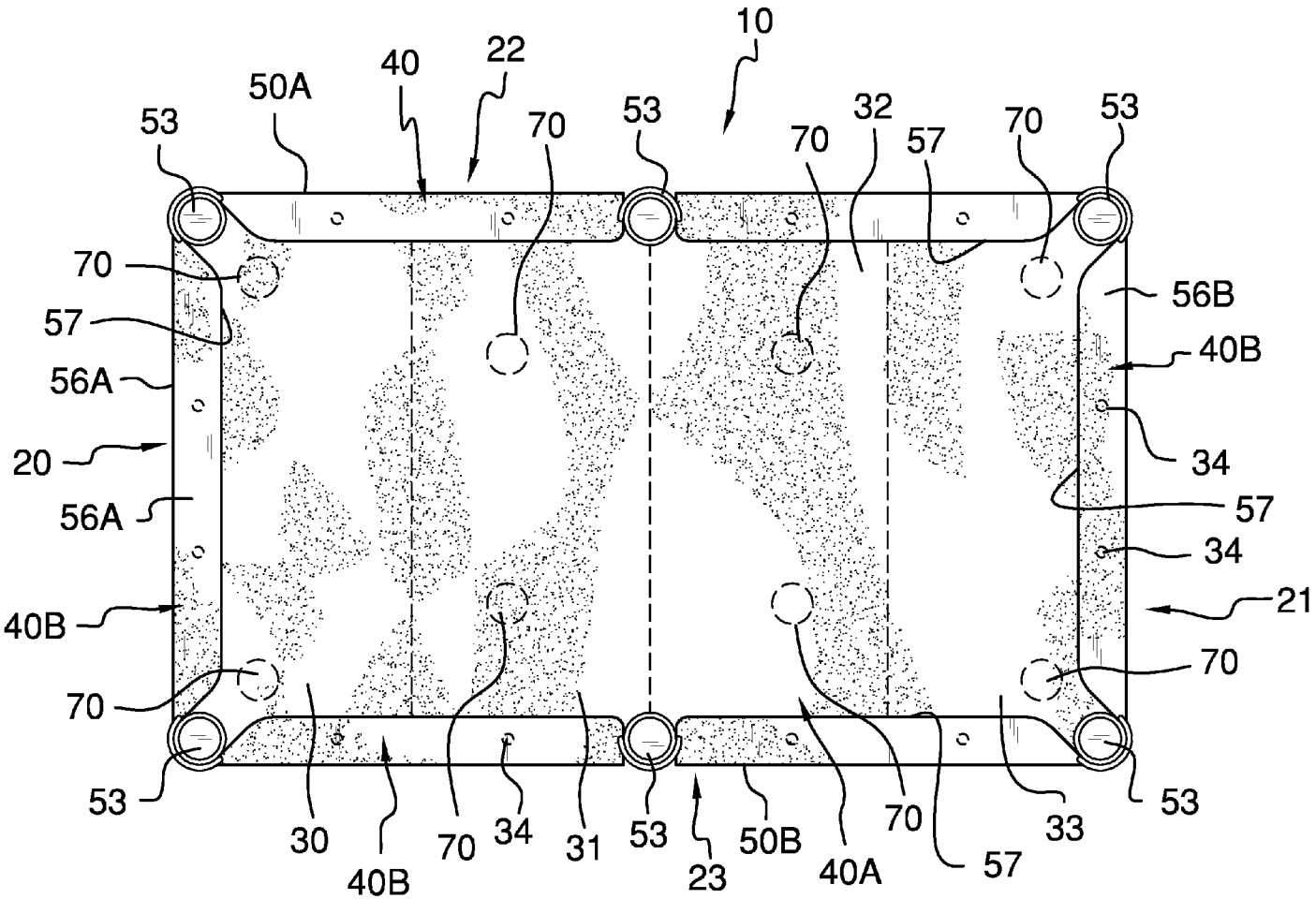
FIG. 1 is a top plan view.

Referring to FIG. 1, a pair of side braces is provided and comprises a first side brace 50A removably disposed atop the sections at the first side 22 and a second side brace 50B removably disposed atop the sections at the second side 23.

Referring to FIG. 5 and again to FIG. 1, a pair of end braces is provided and comprises a first end brace 56A removably affixed atop the outer perimeter 37 of the first section 30 first end 20, and a second end brace 56B removably affixed atop the outer perimeter 37 of the fourth section 33 second end 21. An angled bumper 57 is disposed medially on each side brace and on each end brace. Each brace top 51 and angled bumper 57 is covered with a material 40B comprised of a rubberized layer 41 having a felt cover 42 bonded atop. A plurality of embedded bolts 54 is extended downwardly from each brace. The embedded bolts 54 are in alignment with the holes 34 and the orifices 43. The embedded bolts 54 are configured to pass through the sections. A nut 55 is removably disposed on each embedded bolt 54. The preferred nut 55 is a wing nut 55. The nuts 55 and embedded bolts 54 are thereby configured to affix the side braces to the sections.

Referring to FIG. 2 and FIG. 6, a pair of spaced apart threaded receivers 62 is disposed downwardly on each section.

Figure 3:
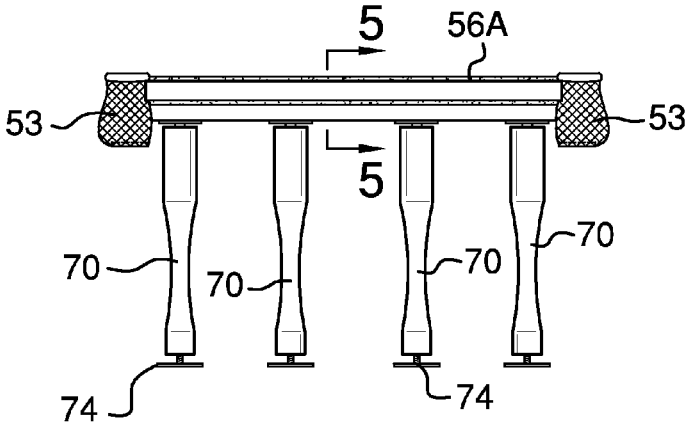
FIG. 3 is an end elevation view.

Referring to FIG. 3 and FIG. 4, the threaded receivers 62 of the second section 31 and the third section 32 are disposed more medially than the threaded receivers 62 of the first section 30 and the fourth section 33.

Referring again to FIG. 6 and FIG. 2, a plurality of legs 70 is provided. Each leg 70 has an upwardly disposed threaded insert 72 and a downwardly disposed adjustable foot 74. The threaded insert 72 of one of each of the legs 70 is removably affixed within one of the threaded receivers 62 of the sections, respectively.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the portable pool table device may be used.

What is claimed is:

1. A portable pool table device comprising, in combination:

a first end spaced apart from a second end, a first side spaced apart from a second side, and a plurality of separable side-by-side sections enclosed by the first, second, third and fourth sections, comprising a first section, a second section removably affixed to the first section, a third section removably affixed to the second section, and a fourth section removably affixed to the third section, each section having an outer perimeter;

a plurality of spaced apart clamps removably affixing the first, second, third and fourth sections together;

a plurality of spaced apart holes disposed in each of the plurality of sections proximal to the outer perimeter;

a plurality of quarter circle cutouts, a one quarter circle cutout disposed at the outer perimeter of the second section first side where the second section is affixed to the third section, one quarter circle cutout disposed at the outer perimeter of the second section second side where the second section is affixed to the third section, one quarter circle cutout disposed at the outer perimeter of the third section first side where the third section is affixed to the second section, and one quarter circle cutout disposed at the outer perimeter of the third section second side where the third section is affixed to the second section;

a pair of half circle cutout shapes, each half circle cutout shape formed where the quarter circle cutouts of the second section and the third section are joined;

a plurality of half circle cutouts, a one half circle cutout disposed at the outer perimeter of the first section first end first side, one half circle cutout disposed at the outer perimeter of the first section first end second side, one half circle cutout disposed on at the outer perimeter of the fourth section second end first side, and one half circle cutout disposed on at the outer perimeter of the fourth section second end second side;

a pocket removably disposed within each half circle cutout shape and within each half circle cutout;

a playing surface removably disposed atop the plurality of sections, the playing surface comprising a rubberized layer in contact with the plurality of sections and a felt cover bonded atop the rubberized layer;

a plurality of orifices disposed within the playing surface, the plurality of orifices aligned with the plurality of holes disposed in of the plurality of sections;

a pair of side braces comprising a first side brace removably disposed atop the plurality of sections at the first side, and a second side brace removably disposed atop the plurality of sections at the second side, each side brace having a top spaced apart from a bottom;

a pair of end braces comprising a first end brace removably affixed atop the outer perimeter of a first end of the first section, and a second end brace removably affixed atop the outer perimeter of a second end of the fourth section, each end brace having a top spaced apart from a bottom;

a plurality of angled bumpers disposed medially on each side brace and on each end brace, a material covers each end brace and side brace top and angled bumper;

a plurality of embedded bolts extending downwardly from each side brace and each end brace, the plurality of embedded bolts in alignment with the plurality of holes and the plurality of orifices, the plurality of embedded bolts configured to pass through the plurality of sections;

a plurality of nuts, each nut removably received on each embedded bolt, the plurality of nuts and the plurality of embedded bolts thereby configured to affix the pair of side and end braces to the plurality of sections;

a pair of spaced apart threaded receivers disposed downwardly on each of said first, second, third and fourth sections;

a plurality of legs, each leg having an upwardly disposed threaded insert and a downwardly disposed adjustable foot, the threaded insert of one of each of the plurality of legs removably received within one of the threaded receivers of the sections, respectively.

2. The device according to claim 1 wherein the removably disposed playing surface atop the plurality of sections extends completely to the outer perimeter of the first, second, third and fourth sections.

3. The device according to claim 1 wherein the plurality of spaced apart clamps further comprise lateral clamps for removably affixing the plurality of sections together.

4. The device according to claim 2 wherein the plurality of spaced apart clamps further comprise lateral clamps for removably affixing the plurality of sections together.

5. The device according to claim 1 wherein the threaded receivers of the second section and the third section are disposed more medially than the threaded receivers of the first section and the fourth section.

6. The device according to claim 2 wherein the threaded receivers of the second section and the third section are disposed more medially than the threaded receivers of the first section and the fourth section.

7. The device according to claim 3 wherein the threaded receivers of the second section and the third section are disposed more medially than the threaded receivers of the first section and the fourth section.

8. The device according to claim 4 wherein the threaded receivers of the second section and the third section are disposed more medially than the threaded receivers of the first section and the fourth section.

9. The device according to claim 1 wherein the angled bumper comprises a rubberized layer and the rubberized layer has a density and thickness different than a density and thickness of the rubberized layer of the playing surface.

10. The device according to claim 2 wherein the angled bumper comprises a rubberized layer and the rubberized layer has a density and thickness different than a density and thickness of the rubberized layer of the playing surface.

11. The device according to claim 3 wherein the angled bumper comprises a rubberized layer and the rubberized layer has a density and thickness different than a density and thickness of the rubberized layer of the playing surface.

12. The device according to claim 4 wherein the angled bumper comprises a rubberized layer and the rubberized layer has a density and thickness different than a density and thickness of the rubberized layer of the playing surface.

13. The device according to claim 5 wherein the angled bumper comprises a rubberized layer and the rubberized layer has a density and thickness different than a density and thickness of the rubberized layer of the playing surface.

14. The device according to claim 6 wherein the angled bumper comprises a rubberized layer and the rubberized layer has a density and thickness different than a density and thickness of the rubberized layer of the playing surface.

15. The device according to claim 7 wherein the angled bumper comprises a rubberized layer and the rubberized layer has a density and thickness different than a density and thickness of the rubberized layer of the playing surface.

16. The device according to claim 8 wherein the angled bumper comprises a rubberized layer and the rubberized layer has a density and thickness different than a density and thickness of the rubberized layer of the playing surface.

* * * * *